US006675870B2

(12) United States Patent
Tilak

(10) Patent No.: US 6,675,870 B2
(45) Date of Patent: Jan. 13, 2004

(54) DIRECT CHILL CASTING MOLD SYSTEM

(76) Inventor: Ravindra V. Tilak, 5261 E. Nantucket La., Anaheim Hills, CA (US) 92807

( * ) Notice: Subject to any disclaimer, the term of this patent is extended or adjusted under 35 U.S.C. 154(b) by 4 days.

(21) Appl. No.: 10/163,017

(22) Filed: Jun. 4, 2002

(65) Prior Publication Data

US 2002/0148593 A1 Oct. 17, 2002

Related U.S. Application Data

(62) Division of application No. 09/571,507, filed on May 15, 2000, now Pat. No. 6,491,087.

(51) Int. Cl.[7] ..... B22D 11/124
(52) U.S. Cl. ..... 164/487; 164/444
(58) Field of Search ..... 164/487, 444, 164/443, 436, 438, 491

(56) References Cited

U.S. PATENT DOCUMENTS

| | | | |
|---|---|---|---|
| 3,598,173 | A | 8/1971 | Dore et al. |
| 3,770,046 | A | 11/1973 | Dore et al. |
| 4,307,772 | A | 12/1981 | Haller |
| 4,572,280 | A | 2/1986 | Haller |
| 4,582,118 | A | 4/1986 | Jacoby et al. |
| 4,598,763 | A | 7/1986 | Wagstaff et al. |
| 4,610,295 | A | 9/1986 | Jacoby et al. |
| 4,693,298 | A | 9/1987 | Wagstaff |
| 4,699,204 | A | 10/1987 | Sautebin et al. |
| 4,709,747 | A | 12/1987 | Yu et al. |
| 4,930,566 | A | 6/1990 | Yanagimoto et al. |
| 5,318,098 | A | 6/1994 | Wagstaff et al. |
| 5,632,323 | A | 5/1997 | Naess, Jr. et al. |
| 5,678,623 | A | 10/1997 | Steen et al. |
| 5,685,359 | A | 11/1997 | Wagstaff et al. |
| 5,846,481 | A | 12/1998 | Tilak |
| 5,873,405 | A | 2/1999 | Carrier et al. |
| 5,915,455 | A | 6/1999 | Kittilsen et al. |
| 5,932,037 | A | 8/1999 | Holroyd et al. |
| 6,032,721 | A | 3/2000 | Steen |
| 6,056,040 | A | 5/2000 | Weaver et al. |
| 6,056,041 | A | 5/2000 | Caron et al. |

FOREIGN PATENT DOCUMENTS

| | | |
|---|---|---|
| WO | WO 97/46342 | 5/1997 |

OTHER PUBLICATIONS

Wagstaff, Robert B. and Bowles, K. Dean, "Practical Low Head Casting (LHC) Mold for Aluminum Ingot Casting", The Minerals, Metals & Materials Society, 1995, pp. 1071–1075.

*Primary Examiner*—M. Alexandra Elve
*Assistant Examiner*—Len Tran
(74) *Attorney, Agent, or Firm*—Blakely, Sokoloff, Taylor & Zafman, LLP

(57) ABSTRACT

An embodiment includes a casting mold. The casting mold may include a mold body having a direction surface and a coolant box coupled to the mold body. The casting mold further may include a coolant ring having a regulation surface where the coolant ring may be coupled to the coolant box so as to bring the regulation surface and the direction surface together to form a nozzle. The casting mold further may include a mold starting head.

9 Claims, 10 Drawing Sheets

DIRECT CHILL CASTING MOLD SYSTEM

RELATED APPLICATION

The present patent application claims the benefits of, and is a divisional of prior application Ser. No. 09/571,507, filed May 15, 2000, now U.S. Pat. No. 6,491,087.

BACKGROUND OF THE INVENTION

1. Field of the Invention

The invention includes the metal founding process of continuously and semi-continuously shaping liquid metal against a forming surface. More particularly, the invention includes direct chill casting of a billet by applying liquid coolant directly to the billet product.

2. Background Information

Founding includes making objects by introducing molten material into a mold where the material solidifies as heat is removed from the material. Slip or continuous casting may be a process whereby molten metal is solidified by gravity feeding the molten metal through a heat absorbing ring. A starting head, having a base mounted to a hydraulic ram, forms an unattached bottom to the heat absorbing ring. The heat absorbing ring and the starting head comprise the basic elements of a slip mold.

When the molten metal fills the mold and begins to solidify, the starting head may be lowered at a controlled rate. Solidified metal may exit the heat absorbing ring to form a billet. Residing above the billet and within the heat absorbing ring may be a solidified metal shell that serves to stabilize the moving billet between the heat absorbing ring and the starting head. Within the sump of this shell may be replenishing molten metal. As molten metal is passed into the shell sump and through the heat absorbing ring, the billet may grow in length.

A billet (or ingot) may be viewed as an elongated mass of metal that is cast in a standard shape by a billet supplier for convenient storage or shipment. The billet may take on the cylindrical cross sectional shape of the heat absorbing ring and may be made of aluminum or aluminum alloy. Even though the heat absorbing ring may be less than two inches in height, a billet may be twenty feet long and have a diameter from three inches to thirty six inches. Manufacturers further process cylindrical billets by thermomechanically forging, extruding, rolling, scalping, or drawing a billet to produce marketable products such as curtain rods for indoors, engine mounts, aircraft landing gear, sheet metal for ships, and I-beams for buildings.

To better control the heat transfer cooling process of the billet, water may be applied directly to the surface of the solid metal as the solid metal exits the heat absorbing ring. Thus, as the starting head lowers, water jets built into the mold may spray water onto the billet to cool the surface and further solidify the metal. This continuous direct chill (DC) casting process, invented in 1942 by W. T. Ennor (U.S. Pat. No. 2,301,027), produces a fine-grained metal structure with minimum segregation. High production rates may be achieved in the casthouse when multiple DC casting molds are used simultaneously in a mold table.

Although some advancements in this area have been made since 1942, there still exists a need in the industry for a direct chill casting mold system package that produces an optimized metallurgical structure of the cast product with desirable surface finish. In comparison to conventional industry mold system packages, this direct chill casting mold system package should be safer to operate, easier to use and maintain, should maximize the casting productivity, and be less expensive to manufacture and operate.

SUMMARY OF THE INVENTION

An embodiment includes a casting mold. The casting mold may include a mold body having a direction surface and a coolant box coupled to the mold body. The casting mold further may include a coolant ring having a regulation surface where the coolant ring may be coupled to the coolant box so as to bring the regulation surface and the direction surface together to form a nozzle. The casting mold further may include a mold starting head.

BRIEF DESCRIPTION OF THEE DRAWINGS

Figure 3A:
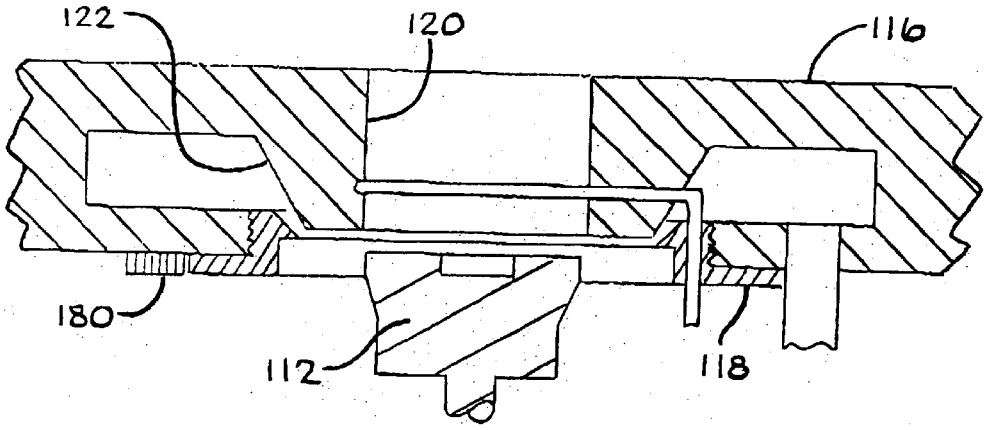
Figure 3B:
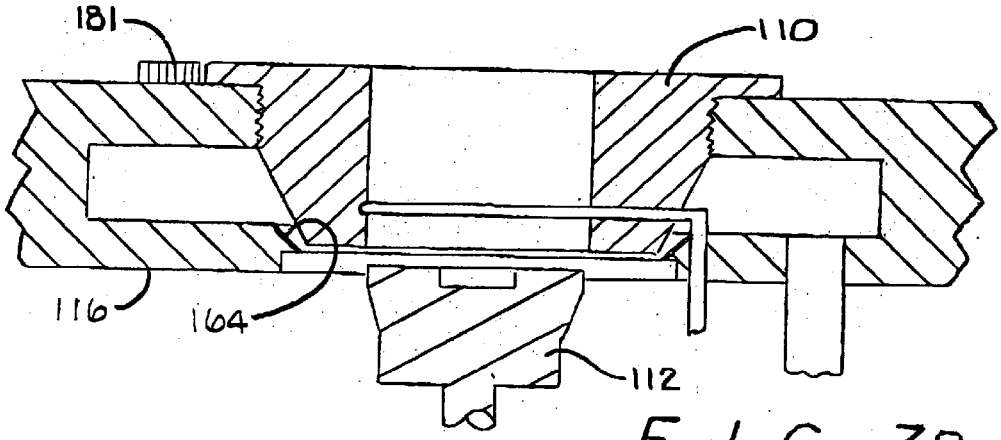
Figure 3C:
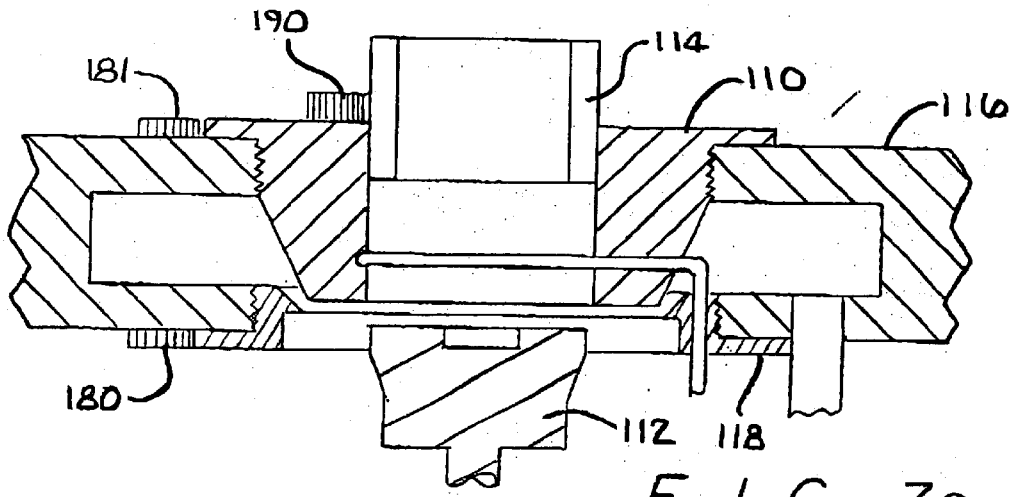
Figure 3D:
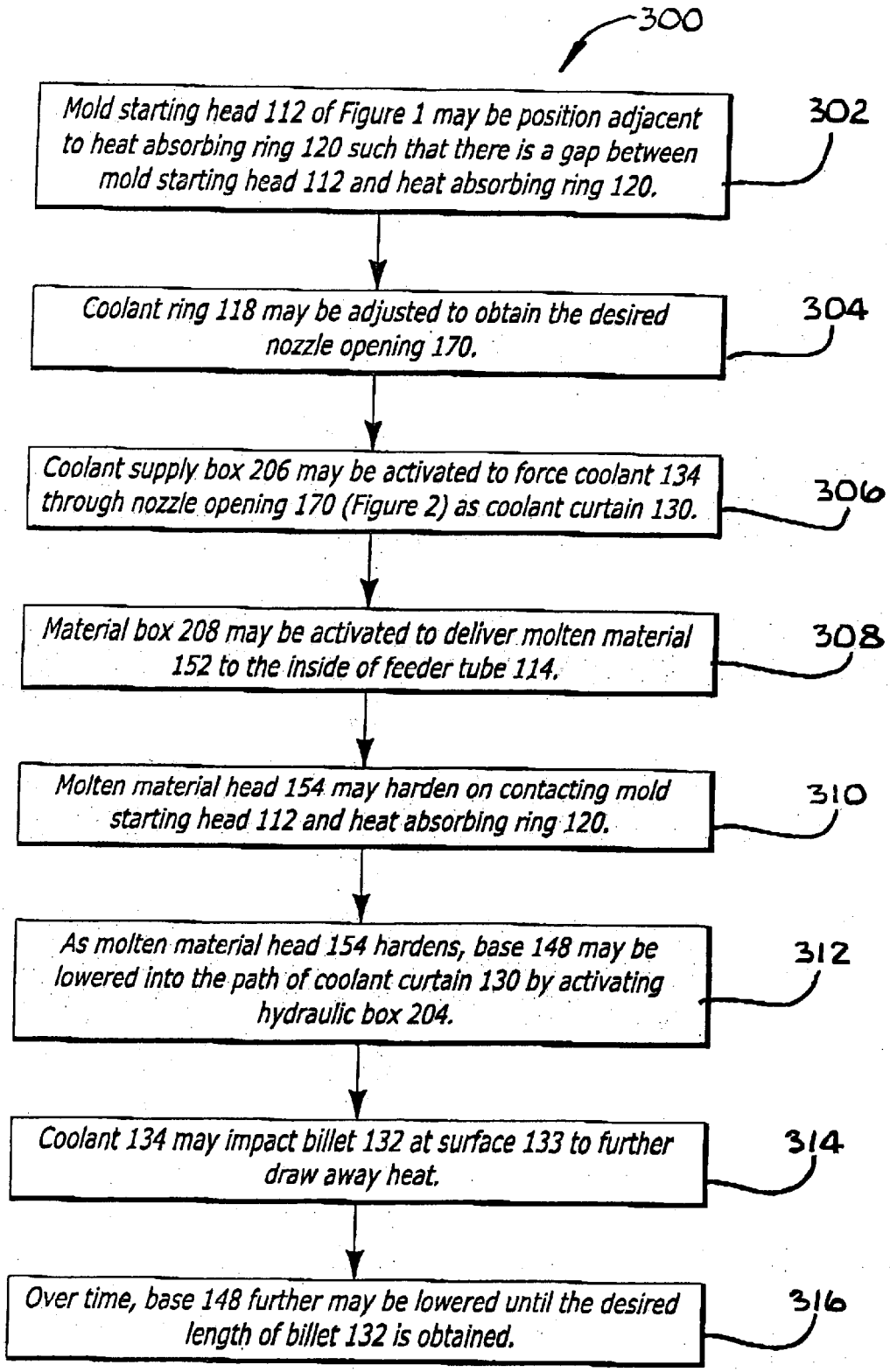
Figure 4:
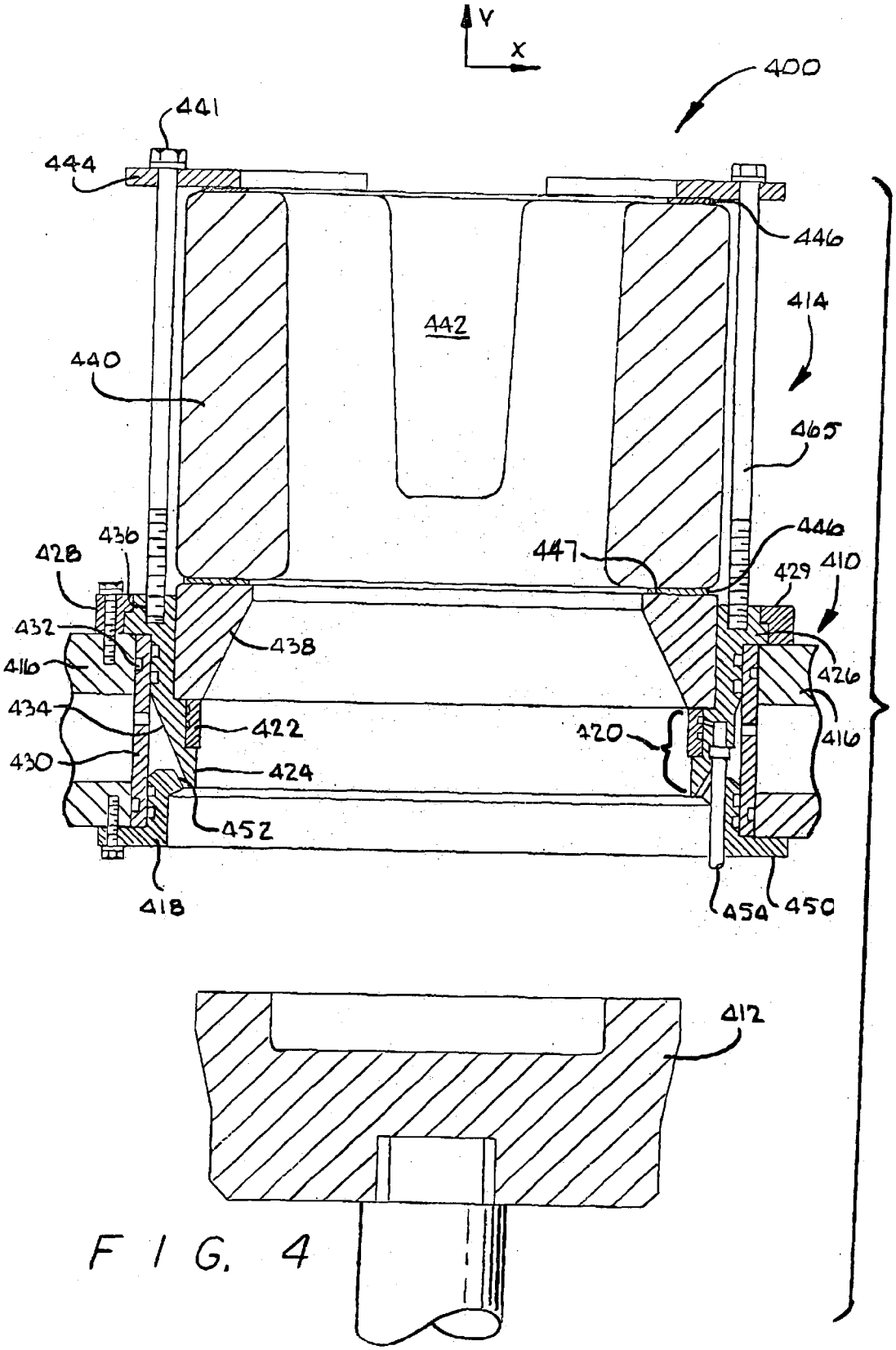
Figure 5:
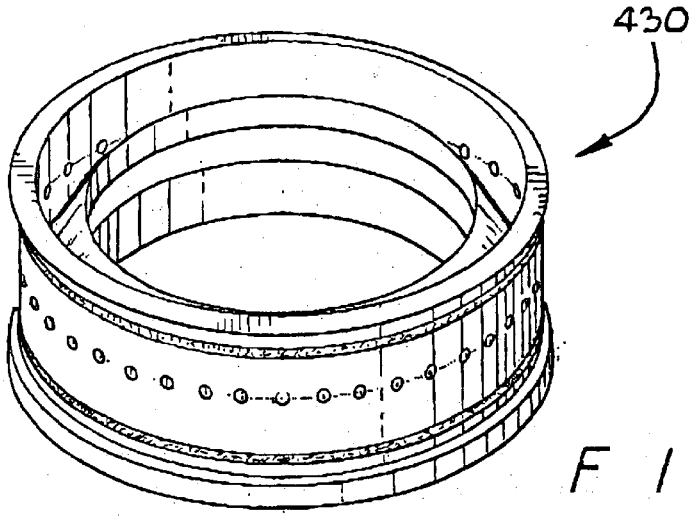
Figure 6:
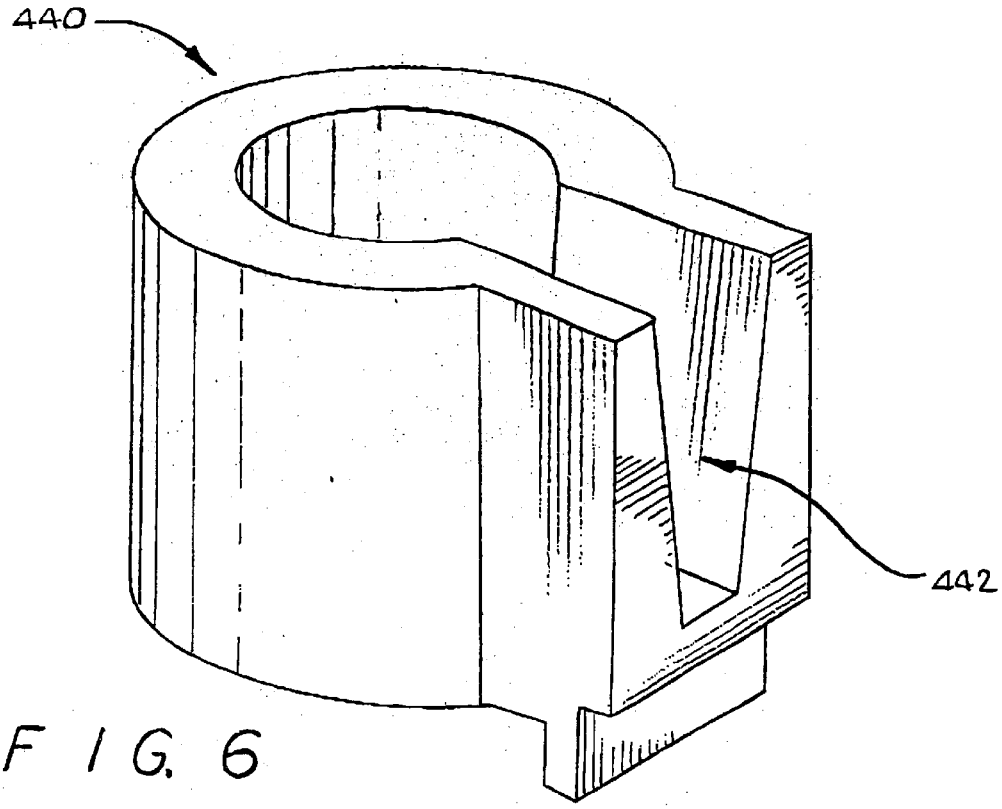
Figure 7:
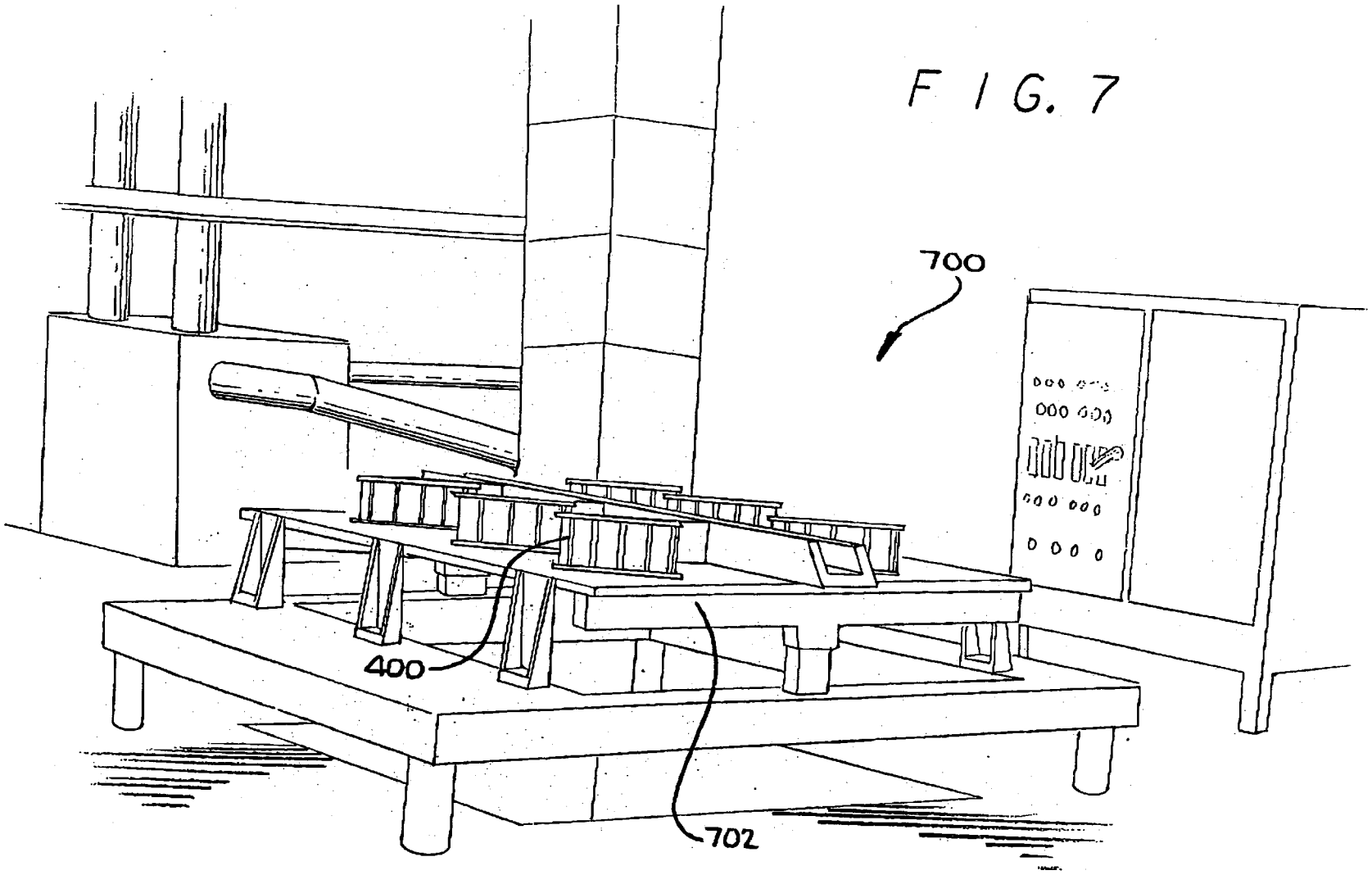
Figure 8:
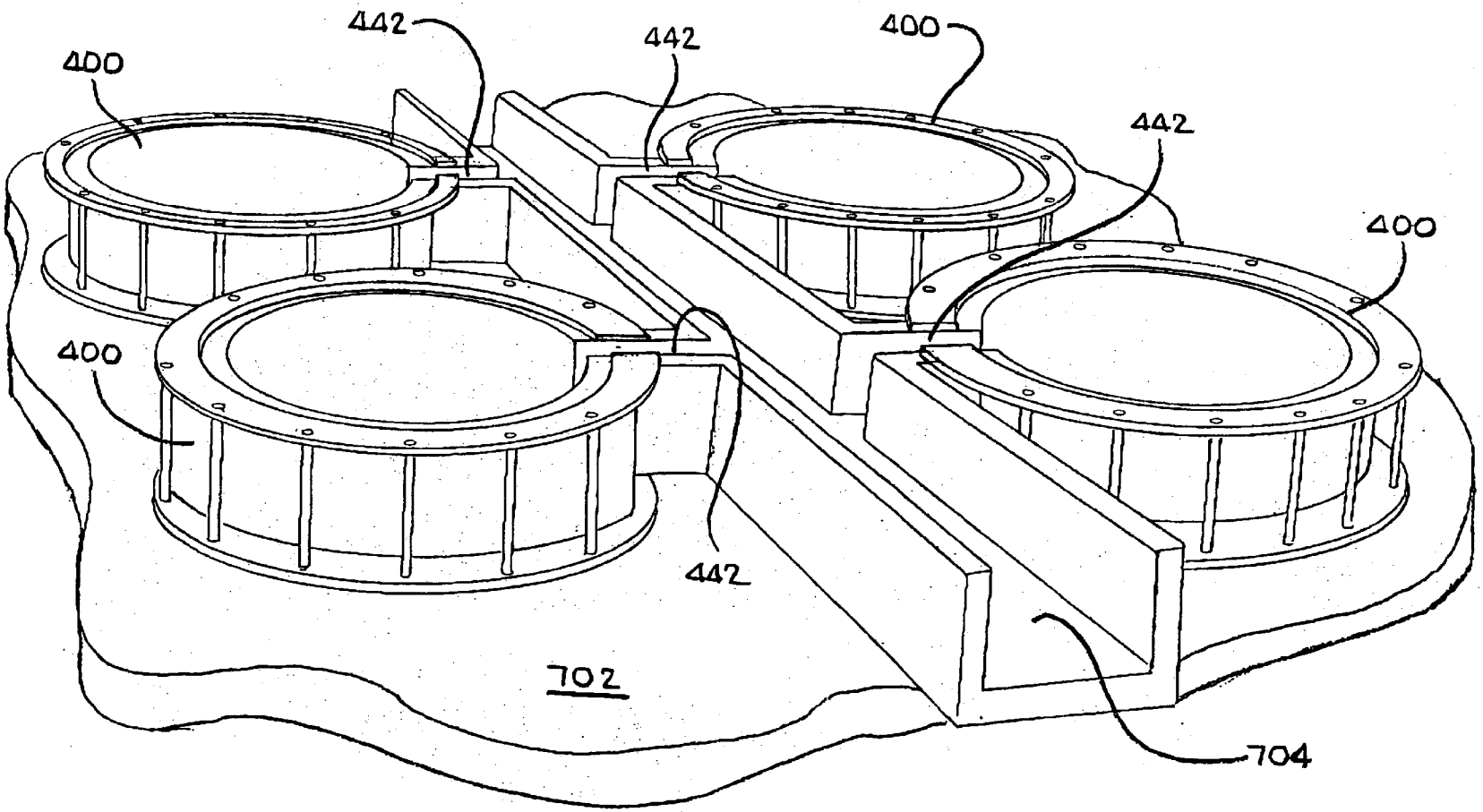
Figure 9:
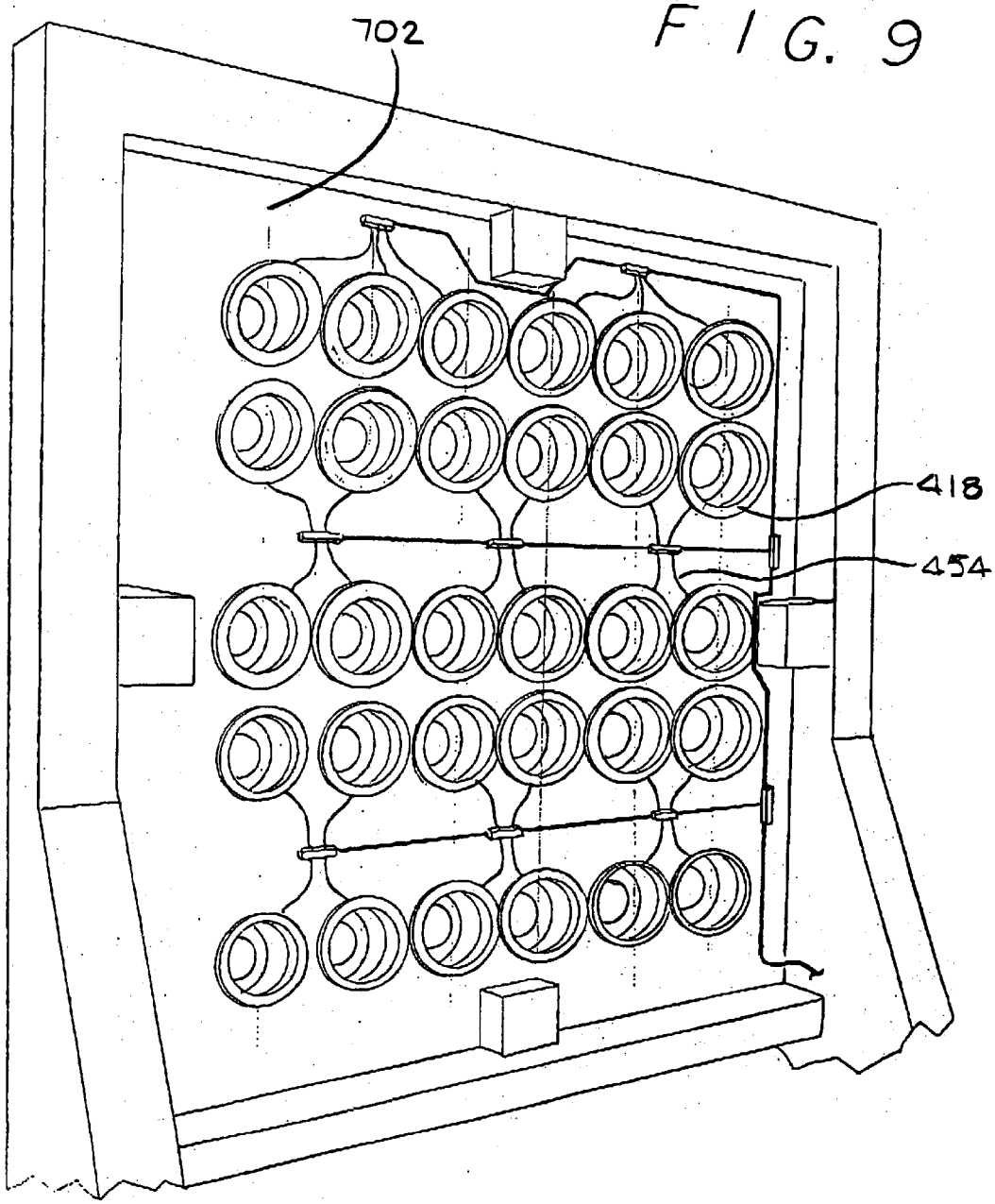
Figure 10:
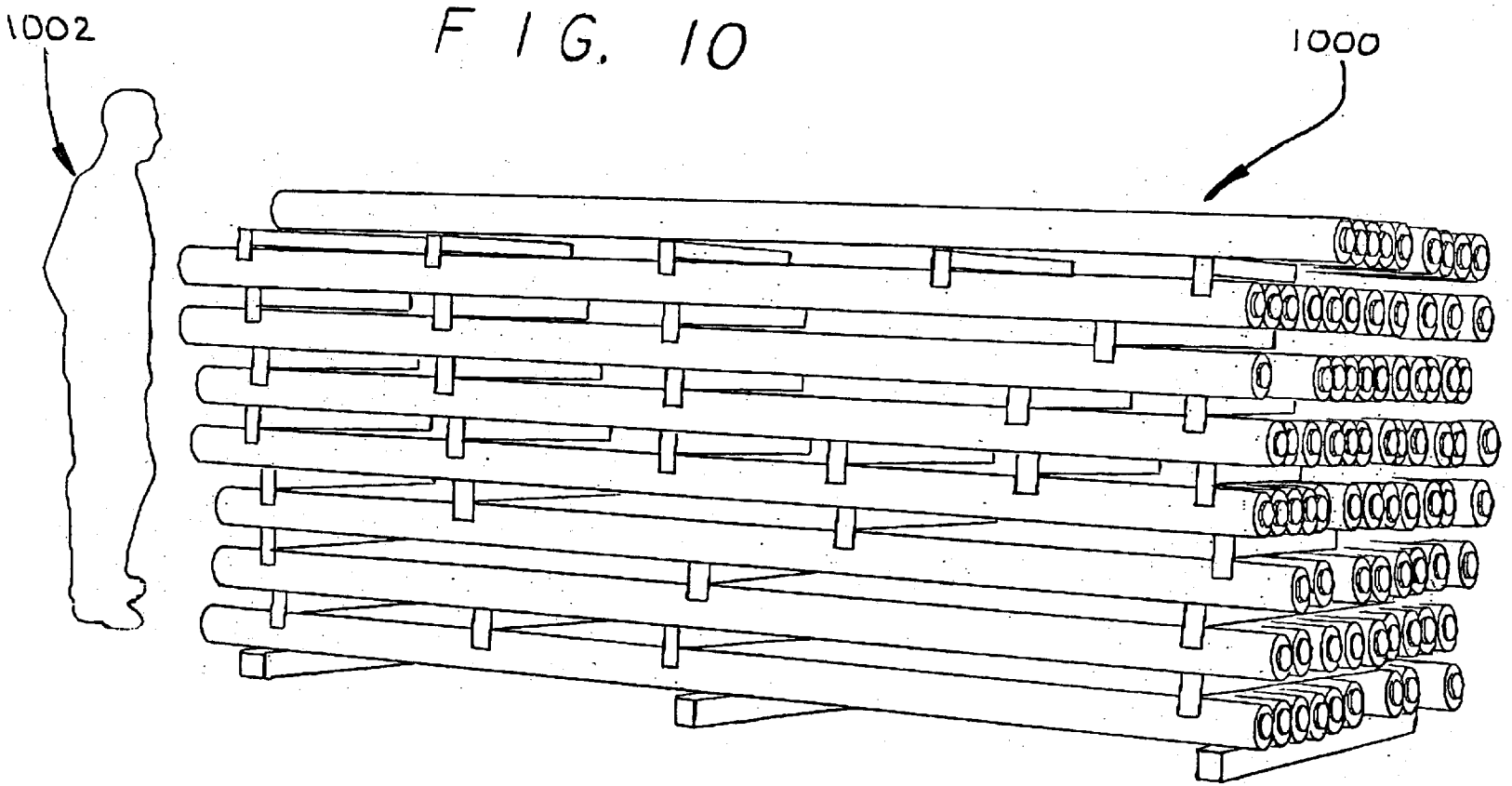

FIG. 3A illustrates heat absorbing ring 120 and direction surface 122 as machined from the material of coolant box 116;

FIG. 3B illustrates regulation surface 164 as machined from the material of coolant box 116;

FIG. 3C illustrates an embodiment where each of mold body 110 and coolant ring 118 may be adjusted;

FIG. 3D sets out method 300 for producing billet 132 of the invention;

FIG. 4 illustrates DC casting mold 400 of the invention;

FIG. 5 illustrates an isometric view of baffle ring 430;

FIG. 6 illustrates an isometric view of ceramic header 440;

FIG. 7 illustrates DC casting mold system 700 of the invention;

FIG. 8 is an isometric top view of mold table 702 of FIG. 7;

FIG. 9 is an isometric bottom view of mold table 702 containing casting mold 400 of FIG. 4; and FIG. 10 illustrates billets 1000 produced by the invention.

DETAILED DESCRIPTION OF THE INVENTION

An embodiment includes a casting mold. The casting mold may include a mold body having a direction surface and a coolant box coupled to the mold body. The casting mold further may include a coolant ring having a regulation surface where the coolant ring may be coupled to the coolant box so as to bring the regulation surface and the direction surface together to form a nozzle particularly such that the nozzle opening, jet turbulence and the angle of coolant impingement can be changed quickly, conveniently and inexpensively. The casting mold further may include a mold starting head.

DC Casting Mold and Mold System

Figure 1:
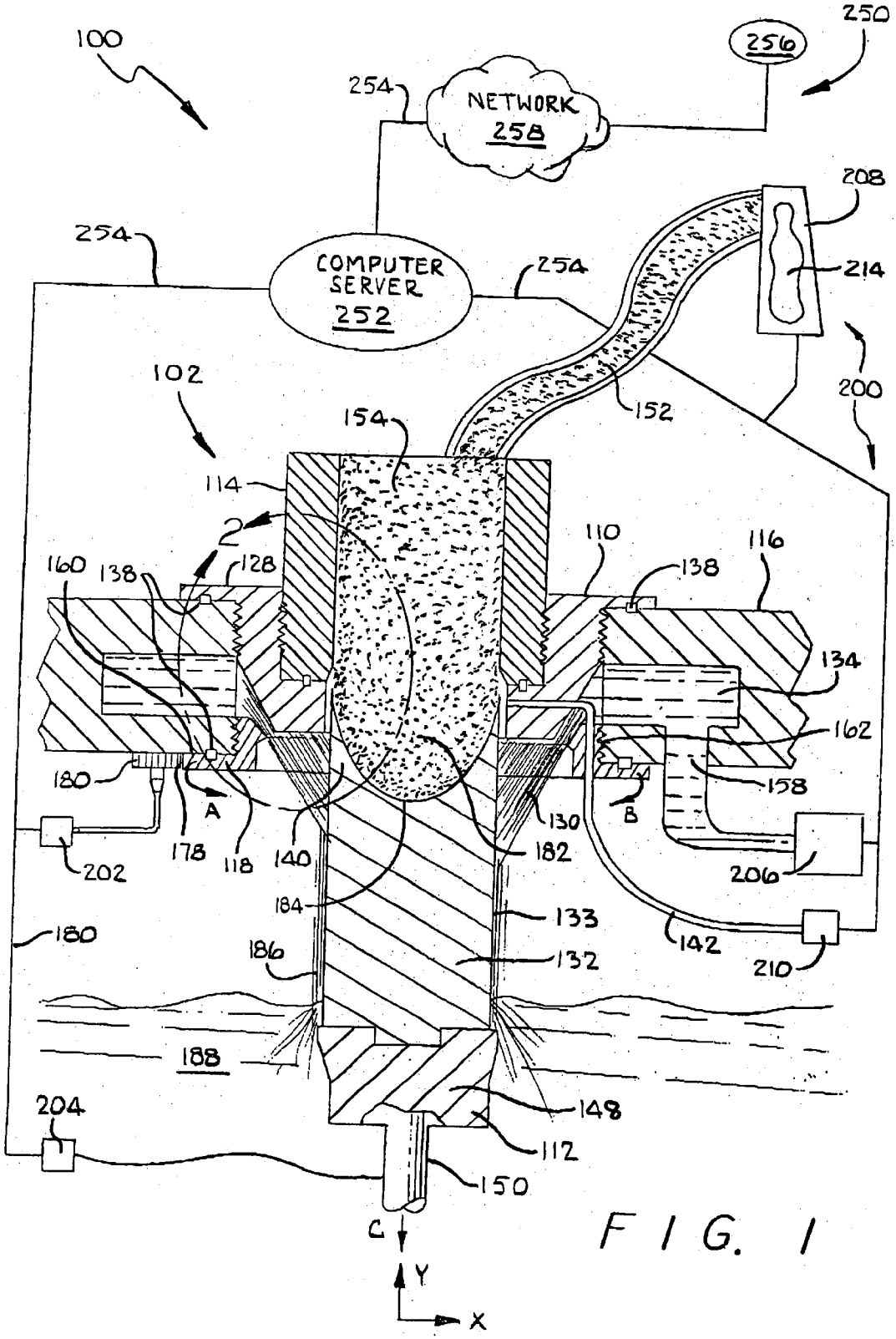
FIG. 1 illustrates DC casting mold system 100 of the invention.

FIG. 1 illustrates DC casting mold system 100 of the invention. Included with DC casting mold system 100 may be mold system 102, auxiliary system 200, and control system 250. Each of mold system 102, auxiliary system 200, and control system 250 may be subsystems that work together to form DC casting mold system 100. Mold system 102 may be viewed as including a DC casting mold.

Mold System 102

Included with mold system 102 may be mold body 110, mold starting head 112, feeder tube 114, coolant box 116, and coolant ring 118.

Figure 2:
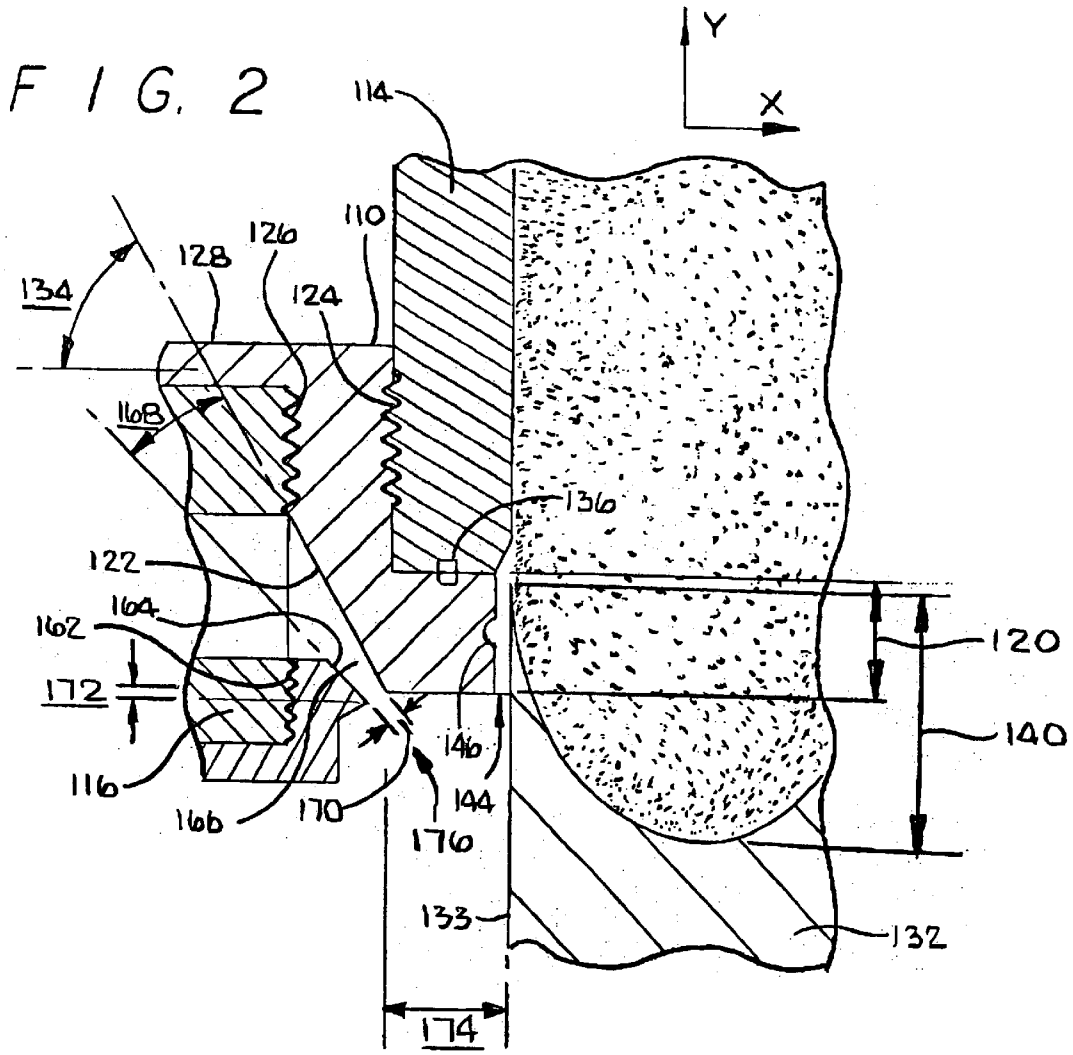
FIG. 2 is a detailed view of mold system 102 taken generally off of line 2 of FIG. 1.

FIG. 2 is a detailed view of mold system 102 taken generally off of line 2 of FIG. 1. As seen in FIG. 2, mold body 110 may include heat absorbing ring 120 at the inner most interior surface of mold body 110. The horizontal cross-section of heat absorbing ring 120 may be defined by any symmetrical or asymmetrical shape used in the extrusion arts or the direct chill casting arts. For example, the horizontal or X-cross-section of heat absorbing ring 120 may be defined by a circular shape, a square shape, a star shape, an oval shape, or a rectangular shape. Since the preferred shape of a billet is a that of a cylinder, in one embodiment, heat absorbing ring 120 is defined by a circular shape. Examples of asymmetrical shapes include rectangular form with rounded corners for slab (rolling) ingot, flat shaped form with concave edges for thin strip casting, and a truncated "T" shaped form for remelt ingot casting. Ingots, slabs, and material that may be cast in a standard shape object also may be produced by the invention.

Mold body 110 may also include direction surface 122, internal threads 124, external threads 126, and lip 128. Direction surface 122 may serve to direct the flow of coolant curtain 130 (FIG. 1) against billet surface 133 of billet 132 at a desired angle 134 (FIG. 2). Angle 134 may be in the range of 60 degrees (°) to 85°. In one embodiment, angle 134 may be in the range of 60° to 75°. Angle 134 may be in reference to a horizontal plane. In another embodiment, angle 134 is in the range of 67° to 72°.

As seen in FIG. 2, feeder tube 114 may be installed into mold body 110 from the top such that gravity may aid in securing feeder tube 114 to mold body 110. Internal threads 124 may be used to further secure feeder tube 114 to mold body 110 as well as provide a surface against which gasket 136 may be compressed. Gasket 136 may be any of a wide variety of seals or packings used between matched machine parts to prevent the escape of a fluid, such molten metal. The material of gasket 136 may have thermal stability at temperatures up to 2100 degrees Fahrenheit, may be chemically non-wetting to molten materials to be cast, may be able to seal any and all internal porosity upon applying compression, may be of material having low heat conductivity and may be of material having low thermal coefficient of expansion or contraction in the temperature range of minus forty to twenty one hundred degrees Fahrenheit. Gasket 136 may include ceramic Kaowool™ type of compressible blanket made and marketed by Thermal Ceramics, Inc., of Augusta, Ga. Gasket 136 may also include Fiberfrax™ J970 type of compressible ceramic paper made and marketed by Unifrax, Inc. of Niagara Falls, N.Y.

Mold body 110 may be installed into coolant box 116 from the top such that gravity may aid in securing mold body 110 to coolant box 116. External threads 126 may be used to further secure mold body 110 to the internal threads of coolant box 116. As best seen in FIG. 1, lip 128 may extend radially outward from a point above external threads 124 so as to provide a surface against which gasket (138) may be compressed.

Gasket 138 may be any of a wide variety of seals or packings used between matched machine parts to prevent the escape of a fluid, such quench water. Gasket 138 may include Viton™, Buna, or silicon materials.

Gasket 138 may be in the shape of an "O"ring. Depending on the extension of lip 128 (which in-turn may depend on the overall diameter of billet 132), the cross section of gasket 138 may vary. The cross section of gasket 138 may be round shaped or oval shape or rectangular with rounded corners. The compressibility of this gasket 138 may provide sealing over a range of 0.005 to 0.250 inches separation of the mating surfaces between which gasket 138 is placed. The cross section of a seat adjacent to gasket 138 may permit static as well as dynamic sealing action.

Since billet 132 of FIG. 1 may be formed by passing molten material 152 through heat absorbing ring 120, a friction reducing element may be included between billet surface 133 of billet shell 140 and heat absorbing ring 120. For example, lubricant 142 may be introduced into gap 144 of FIG. 2 through lubrication channel 146 as a friction reducing element. As noted in more detail below, lubricant 142 may be a liquid, such as oil, or a gas, such as one of the inert gases, or a mixture of gases, or a combination thereof.

Mold body 110 may include an aluminum alloy, a copper-beryllium alloy, or a graphite based material. The aluminum alloy may be aluminum alloy AA6061 or aluminum alloy AA5052. The material for mold body 110 may exhibit thermal stability and inertness towards molten materials to be cast. Moreover, he material for mold body 1110 may provide sufficient heat conductivity and provide the ability to hold close dimensional tolerances during both machining and extreme temperature conditions that may be encountered in casting.

In an alternate embodiment, mold body 110 and coolant box 116 are a single element. For example, FIG. 3A illustrates heat absorbing ring 120 and direction surface 122 as machined from the material of coolant box 116. Where coolant box 116 includes absorbing ring 120 and direction surface 122, and where heat absorbing ring 120 and direction surface 122 define mold body 110, internal threads 124, external threads 126, lip 128, and gasket 138 of FIG. 1 may not be required as part of mold system 102. Where internal threads 124 may not be required as part of mold system 102, feeder tube 114 may be omitted as shown in FIG. 3A such that absorbing ring 120 may directly receive a supply of molten material 152 for processing into billet 132. Lubrication channel 146 may be eliminated. For example, lubrication channel 146 may be eliminated where the friction coefficient between heat absorbing ring 120 and molten material head 154 is low enough to pass molten material through heat absorbing ring 120.

As seen in FIG. 1, mold system 102 may also include mold starting head 112. Mold starting head 112 may include base 148 and hydraulic ram 150. Mold starting head 112 may serve as an unattached bottom to heat absorbing ring 120. Hydraulic ram 150 may be coupled to a platen.

Included with mold system 102 also may be feeder tube 114 as coupled to mold body 110. Feeder tube 114 may work to deliver molten material 152 as molten material head 154 to a first opening in heat absorbing ring 120. Molten material head 154 may provide a positive pressure head to drive billet 132 past heat absorbing ring 120.

It may be undesirable to have molten material 152 cooling prior to reaching heat absorbing ring 120. Thus, feeder tube 114 may work to adiabatically deliver molten material head 154 to heat absorbing ring 120. To accomplish this delivery with minimal heat loss, feeder tube 114 may be made from any of various hard, brittle, heat-resistant and corrosion-resistant materials.

The material included with feeder tube 114 may exhibit low heat conductivity, low coefficient of volumetric expansion, high resistance to thermal fatigue, strength at high temperature, and a chemically non-wetting behavior to the molten materials to be cast. In one embodiment, feeder tube 114 includes a nonmetallic mineral, such as clay. In another embodiment, feeder tube 114 may include a ceramic material. The ceramic material may be based on a pure sigma Alumina and Kaoline composition. The ceramic material may include aluminum silicate. In another embodiment, the ceramic material of feeder tube 114 may be made by vacuum forming a slurry of silicon-di-oxide with suitable high temperature bonding agents added to the slurry. The resulting slurry subsequently may be sintered to achieve cohesiveness and strength.

Also included with mold system 102 may be coolant box 116. To contain and channel coolant 134, coolant box 116 may include cavity 156 and coolant inlet 158 placed in fluid communication with cavity 156. As noted above, mold body 110 may be coupled to coolant box 116 through external threads 126. Coolant box 116 may include primer coated 1020 Steel or stainless steel such as type SS 316. In one embodiment, coolant box 116 includes aluminum alloy AA5052 or AA6061-T651 stress relieved plate stock. The materials included with coolant box 116 may be machinable to very close tolerances such as plus or minus two thousands of an inch and may be able to hold the tolerances over a long period of time, such as several years.

Another item that may be included as part of mold system 102 may be coolant ring 118. Included with coolant ring 118 may be lip 160, external threads 162, and regulation surface 164. As best seen in FIG. 1, lip 160 may extend radially outward from a point below external threads 162 so as to provide a surface against which gasket 138 may be compressed. External threads 162 may be used to secure coolant ring 118 to the internal threads of coolant box 116.

As seen in FIG. 2, with coolant ring 118 installed into coolant box 116, regulation surface 164 of coolant ring 118 may meet direction surface 122 of mold body 110 at angle 168 to define internal nozzle region 166 and nozzle opening 170. Angle 168 may be in the range of 0° to 90° since coolant 134 ejects from nozzle 176 more along direction surface 122. In one embodiment, angle 168 is in the range of 4° to 12°. In another embodiment, angle 168 is 6°.

Nozzle opening 170 may be defined by the average cross sectional distance between the lowest Y-point on direction surface 122 in a first X-Y plane and the adjacent, lowest Y-point on regulation surface 164 in the first X-Y plane. The average cross sectional distance of nozzle opening 170 may be in the range of 0.050 inches to 0.150 inches. In one embodiment, the average cross sectional distance of nozzle opening 170 is in the range of 0.075 inches to 0.108 inches.

Nozzle opening 170 also may be defined by nozzle height 172 and nozzle distance 174. Nozzle height 172 may be defined by the Y-distance between the lowest Y-point on direction surface 122 in a first X-Y plane and the adjacent, lowest Y-point on regulation surface 164 in the first X-Y plane. Nozzle distance 174 may be defined as the extent of space in the X direction between the center of nozzle opening 170 and billet surface 133.

Nozzle height 172 may be in the range of plus or minus 0.200 inches. In one embodiment, nozzle height 172 is in the range of zero inches to 0.100 inches. In another embodiment, nozzle height 172 is a multiple of 0.010, irrespective of the units used. In a further embodiment, nozzle height 172 is zero inches. Where nozzle height 172 is zero inches, regulation surface 164 does not overhang direction surface 122. Where there is no overhang, regulation surface 164 may not encourage the bottom half of a coolant column from nozzle 176 to diverge from the upper half of that same coolant column as discussed below.

Nozzle distance 174 may be in the range of 0.06 inches to 0.36 inches. In another embodiment, nozzle distance 174 is a multiple of at least one of 0.001 and 0.006, irrespective of the units used. In a further embodiment, nozzle distance 174 is one of 0.090 inches and 0.106 inches.

Internal nozzle region 166 may work with nozzle opening 170 as nozzle 176 to regulate and direct a flow of fluid (such as coolant 134) from nozzle 176 as coolant curtain 130. Coolant curtain 130 may be an uninterrupted, laminar flow of coolant disposed about billet surface 133. The laminar flow of coolant curtain 130 may lack the intermittent spaces that characterizes conventional coolant flow in DC casting molds so as to provide better heat transfer characteristics.

To regulate the fluid volume and force of coolant curtain 130 and direction of coolant curtain 130, an embodiment of the invention includes the ability to adjust nozzle height 172 and, in turn, the angle at which coolant curtain 130 impacts billet 132.

Radially extending outward from lip 160 of coolant ring 118 may be gear teeth 178. To mate with gear teeth 178, another item that may be included as part of mold system 102 may be coolant ring gear 180. Coolant ring gear 180 may be located so as to mesh with gear teeth 178 and permit rotation of coolant ring 118. Rotation of coolant ring 118, in turn, may permit adjustments to the shape and volume of coolant 134 exiting nozzle 176. Additional frictional reducing elements, such as bearings and grease, may be added to mold system 102 to make it easier to rotate coolant ring 118.

In a DC casting mold, heat transfer from a billet may be a function of coolant velocity, thickness of coolant film, volume of coolant, angle of impingement, and the Reynolds number of the coolant flow as the coolant impacts the surface of a billet. Assuming the other variables maintain themselves, the higher the coolant velocity up to a threshold, the higher the heat transfer. Although an increase in the coolant pressure would increase the coolant velocity, coolant pump capacity generally is fixed. The ability to adjust the shape and volume of coolant 134 exiting nozzle 176 may present the ability to adjust at least one of the coolant velocity, the film thickness, and the angle of impingement. Thus, the ability to adjust the shape and volume of coolant 134 exiting nozzle 176 may provide the almost instantaneous ability to change the heat transfer characteristics of a DC casting mold.

In operation, as coolant ring gear 180 is rotated in one direction, coolant ring 118 rotates in the direction of arrow A of FIG. 1 so as to decrease nozzle height 172 of FIG. 2. Decreasing nozzle height 172 may decrease the nozzle opening 170. Assuming a constant pressure, the volume of coolant 134 exiting nozzle 176 decreases to give more of a knife edge to coolant curtain 130. Moreover, decreasing nozzle height 172 may move the center of nozzle opening 170 towards billet surface 133 so as to decrease nozzle distance 174 and increase the angle at which coolant curtain 130 impacts billet 132 as coolant 134 is pulled towards coolant ring 118. Rotating coolant ring gear 180 in the opposite direction may rotate coolant ring 118 in the direction of arrow B of FIG. 1.

In an alternate embodiment, coolant ring 118 and coolant box 116 are a single element. For example, FIG. 3B illustrates regulation surface 164 as machined from the material of coolant box 116. Where coolant box 116 includes regulation surface 164, lip 160, external threads 162, and gasket 138 may not be required as part of mold system 102. As shown in FIG. 3B, mold body 110 may be adjusted up or down through coolant ring gear 181 coupled to teeth disposed about lip 182 to vary nozzle opening 170.

In another alternative embodiment, each of mold body 110 and coolant ring 118 may be adjusted to vary the cross section of nozzle opening 170 in at least one of the X, Y, and Z direction as well as adjusted to vary a mean X-diameter of nozzle opening 170. FIG. 3C illustrates an embodiment where each of mold body 110 and coolant ring 118 maybe adjusted. Here, each of mold body 110 and coolant ring 118 may be adjusted to vary the position of nozzle opening 170. To provide a greater molten material head 154 in this embodiment, feeder tube 114 may be engaged by threads to the inside surface of mold body 110 and can be remotely move up or down through a mesh engagement between gear 190 and teeth disposed about feeder tube 114. Where feeder tube 114 is fragile, a toothed annulus ring may be used about feeder tube 114 to engage gear 190.

In an alternate embodiment, the adjustment of at least one of mold body 110 and coolant ring 118 may be in at least one of the Y-direction, the X-direction, a pitch direction, a roll direction, a yaw direction, and a polar direction. Auxiliary system 200

Included with DC casting mold system 100 of FIG. 1 may be auxiliary system 200. Auxiliary system 200 may include hydraulic box 202, hydraulic box 204, coolant supply box 206, material box 208, and lubricant box 210. Hydraulic box 202 may be coupled to coolant ring gear 180 to control the movement of coolant ring gear 180 and thus control coolant curtain 130. Hydraulic box 204 may be coupled to mold starting head 112 through hydraulic ram 150 such as through a platen to control the movement of mold starting head 112. Hydraulic box 202 and hydraulic box 204 may be a single power box that operates by a fluid, especially water or air, under pressure.

Coolant supply box 206 may be coupled to coolant inlet 158 so as to supply coolant 134 as a quench fluid to coolant box 116. In one embodiment, coolant 134 is a liquid. The liquid may be water, or water mixed with glycol (for example, 3% to 25% glycol by volume).

Material box 208 may contain material 214 that is to be processed into billet 132. Material box 208 may be coupled to the interior of feeder tube 114 to provide a supply of molten material 152 for processing into billet 132. Material 214 may be any material capable of being changed from a solid to a liquid state by application of at least one of heat and pressure.

In one embodiment, material 214 is a metal. The metal may include aluminum, aluminum alloys, magnesium, magnesium alloys, copper, copper alloys, Lithium, Lithium alloys, or noble metals and their alloys. In another embodiment, material 214 is a plastic. The plastic may include a thermoplastic resin, including polystyrene or polyethylene. In another embodiment, the material may include glass. The glass may include colored glass. In another embodiment, the material may include a two phase mixture. The two phase mixture may include a metal-matrix composite. The metal-matrix composite may include one of metal and ceramic particles, and metal and amorphous glass particles. In another embodiment, the material may include a thixotropic slurry in semi-solid condition.

Lubricant box 210 may be coupled to lubrication channel 146 of FIG. 2 to deliver a friction reducing element to gap 144. Lubricant 142 may be a liquid, such as oil, a gas, such an one of the inert gases, a solid state material, or a combination thereof.

The lubricants may exhibit physical compatibility and chemical compatibility with the material to be cast (such as material 214) and with the cooling media employed. The factors of lubricant physical compatibility may include flash point, specific gravity, specific heat, surface tension, and fluidity of the lubricant. The factors of lubricant chemical compatibility may include surface reactivity, decomposition products, reversibility of chemical reaction, separability of the lubricant from the cooling media, and environmental consideration of disposition of the spent lubricant A preferred liquid lubricant may include biodegradable vegetable oils such as peanut oil and caster oil. Synthetic mineral oils also may be employed. Moreover, synthetic oils with additions of alpha olefins may be used.

Gaseous lubricants may be mixture of inert gases applied with or without further mixture with air. The solid state lubricants may be graphite ring inserts, graphite powder and molybdenum-di-sulphide powder.

Control System 250

Included with DC casting mold system 100 of FIG. 1 may be control system 250. Control system 250 may include computer server 252 and communication lines 254. Computer server 252 may be any device that computes, especially a programmable electronic machine that performs high-speed mathematical or logical operations or that assembles, stores, correlates, or otherwise processes information. Communication lines 254 may serve to send communication signals between computer server 252 and hydraulic box 202, hydraulic box 204, coolant supply box 206, material box 208, and lubricant box 210. The communication signals may be sent through at least one of wire cables and wireless cables.

Control system 250 also may include computer clients 256 coupled to computer server 252 through network 258. Network 258 may be any system of computers interconnected by communication channels, such as telephone wires, cables, and radio waves, in order to share information. In one embodiment, network 258 is the Internet. The Internet may be any global information system that may be logically linked together by a globally unique address space based on an Internet Protocol (IP) or its subsequent extensions/follow-ons and may be able to support communications using the Transmission Control Protocol/Internet Protocol (TCP/IP) suite or its subsequent extensions/follow-ons, and/or other IP-compatible protocols. In one embodiment, the Internet may provide, use or make accessible, either publicly or privately, high level services layered on the communications and related infrastructure. In another embodiment, network 258 is a plurality of telephone connection.

Operation

A first method of molding an object such as billet 132 may include presenting a mold body having a direction surface, a coolant box, and a coolant ring having a regulation surface. The next step may be to form a nozzle in a manner that provides an ability to adjust a nozzle opening by disposing the regulation surface adjacent to the direction surface. This may be done by coupling the coolant box between the coolant ring and the mold body. The nozzle may be adjusted to change the nozzle opening. The adjustment may be static or dynamic.

The method may further include passing coolant through the nozzle to form a coolant curtain and hardening molten material by passing the molten material though the mold body and the coolant ring and contacting the molten material with a mold starting head.

The hardened material may then be passed through the coolant curtain by lowering the mold starting head. If desired, the nozzle may be readjusted as the hardened material passes through the coolant curtain. In one embodiment, adjusting the nozzle includes at least one of rotating a gear and adding a shim, wherein the gear is in rotation contact with at least one of the coolant ring and the mold body and wherein the shim is disposed between at least one of the coolant box and the mold body and the coolant ring and the coolant box.

FIG. 3D sets out method 300 for producing billet 132 of the invention. As step 302, mold starting head 112 of FIG.

1 may be position adjacent to heat absorbing ring 120 such that there is a gap between mold starting head 112 and heat absorbing ring 120. At step 304, coolant ring 118 may be adjusted to obtain the desired nozzle opening 170. Adjustment may be by activating coolant ring gear 180 or by inserting/removing shims as discussed below. At step 306, coolant supply box 206 may be activated to force coolant 134 through nozzle opening 170 (FIG. 2) as coolant curtain 130. At step 308, material box 208 may be activated to deliver molten material 152 to the inside of feeder tube 114. This may form molten material head 154. At step 310, molten material head 154, such as that at the surface along the perimeter may harden to form shell 140 on contacting mold starting head 112 and heat absorbing ring 120 due to the significant temperature differential between molten material head 154 and the two elements of mold starting head 112 and heat absorbing ring 120.

Metallostatic pressure may vary over the depth of a column liquid material and may be expressed as the density of the material times the gravitational constant time the height of the liquid column. The phase transformation from molten material head 154 to shell 140 may occur when material head 154 either solidifies or partially solidifies such that the phased changed material exhibits enough strength (for example, thickness) to withstand the metallostatic pressure of the material head 154. As molten material head 154 hardens, base 148 may be lowered at step 312 in the direction of arrow C into the path of coolant curtain 130 by activating hydraulic box 204. To provide a more uniform billet 132, base 148 may be rotated as it is lowered where the cross section of heat absorbing ring 120 permits.

As base 148 is lowered into the path of coolant curtain 130 at step 312, coolant 134 may impact billet 132 at surface 133 to further draw away heat at step 314. Over time, base 148 further may be lowered at step 316 until the desired length of billet 132 is obtained.

It takes time for the entire X-cross section of molten material 152 to solidify. Thus, as the material furthest from the Y-centerline of billet 132 cools, billet shell 140 may form. The formation of billet shell 140 may create sump 182. Sump 182 and billet shell 140 may meet at liquidus surface 184. A cross section of liquidus surface 184 may be defined by a concave parabola. The properties of this concave parabola may be based on the meniscus formed at the top end of billet 132 due to the movement of base 148 as molten material 152 cools.

Coolant 134 from coolant curtain 130 at approximately 30 to 120 degrees Fahrenheit (° F.) may impact billet surface 133, where billet surface 133 may be at approximately 900° F. Due to the large temperature differential (~830° F.), coolant 134 may evaporate into its vapor phase where coolant 134 is a liquid. For example, where coolant 134 is water, the water may vaporize into minute steam bubbles that adhere to billet surface 133.

As noted above, when a first measure of water impacts billet 132, minute steam bubbles form on billet surface 133. Principally, the minute steam bubbles are formed by the upper half of a coolant column from nozzle 176. When the subsequent, second measure of water impacts billet 132, the second measure of water shears the minute steam bubbles from billet surface 133 and forms its own minute steam bubbles. Principally, the minute steam bubbles are sheared from billet surface 133 by the lower half of a coolant column from nozzle 176.

Where nozzle height 172 of FIG. 2 is greater than zero inches, the additional surface adhesion between coolant 134 and the overhang of regulation surface 164 may encourage the bottom half of the coolant column from nozzle 176 to diverge from the upper half of that same coolant column. Where the bottom half of the coolant column diverges from the upper half of that same coolant column, the billet impingement velocity of the bottom half of the coolant column decreases due to at least one of the internal shearing forces in the water stream and the increase in distance the bottom half of the coolant column must travel before impinging billet surface 133. This lessens the steam bubble shearing properties of the coolant column such that more steam bubbles remain on billet surface 133. With more steam bubbles remaining on billet surface 133, the heat transfer from billet 132 is reduced. Thus, to minimize impingement velocity gradient over the vertical profile of a coolant column, nozzle height 172 of FIG. 2 preferably is zero inches for certain materials.

Where casting materials that are highly quench sensitive, a delayed heat extraction along billet surface 133 may be preferable. For these applications, the presence of a velocity gradient over the vertical profile of a coolant column may be desirable and, accordingly, nozzle height 172 of FIG. 2 may be other than zero inches.

Shearing steam bubbles from billet surface 133 promotes heat transfer by freeing up areas of billet surface 133 to come into contact with coolant 134. The value chosen for angle 134 of FIG. 2 may promote shearing of steam bubbles from billet surface 133. Heat transfer may also occur over a span of twelve inches beyond the point coolant 134 impinges surface 133. In addition to promoting steam bubble shearing, the value chosen for angle 134 may work to minimize the quantity of coolant 134 that bounces from billet surface 133. Experiments have shown that the preferred range for angle 134 is 60° to 75° as noted above.

As coolant 134 from coolant curtain 130 impacts billet 132, water sheet 186 of FIG. 1 may cascade down billet surface 133. In one embodiment, water sheet 186 cascades down billet surface 133 at six feet per second. Water sheet 186 may cascade down billet surface 133 of billet 132 and into sink 188. To make a twenty foot long billet, base 148 may be lowered over approximately ninety minutes. At some point during this time, billet 132 may be lowered into sink 188.

Bubbles remaining on billet surface 133 may turn into free rising steam. Bubbles sheared free from billet surface 133 may be carried into sink 188 by water sheet 186, where they do not turn into free rising steam. Thus, sink 188 may help control the formation of steam as well as provide a reservoir from which to recycle coolant 134. Sink 188 may be eight to ten feet deep.

Controlling coolant curtain 130 may also help control the formation of steam. If too much steam is being generated or billet 132 is not cooling properly, coolant ring 118 may be adjusted during the movement of base 148 to obtain the desired nozzle opening 170 by activating coolant ring gear 180 so as to carry more steam bubbles into sink 188.

FIG. 4 illustrates DC casting mold 400 of the invention. Included with DC casting mold 400 may be mold body 410, mold starting head 412, feeder tube 414, coolant box 416, and coolant ring 418. As seen in FIG. 4, mold body 410 may include heat absorbing ring 420 at an inner most interior surface of mold body 410. Heat absorbing ring 420 may include porous ring 422 and mold tang 424.

Molten material 152 of the invention may move as it solidifies. Thus, porous ring 422 may function to admit the passage of fluid through pores or interstices within the material of porous ring 422 to provide a friction reducing surface between porous ring 422 and a billet shell, such as billet shell 140. This fluid, whether liquid, gas, or a combination thereof, may provide a friction reducing surface between molten material and porous ring 422 to allow molten material to pass through porous ring 422.

To admit the passage of fluid through pores or interstices within the material of porous ring 422, porous ring 422 may include a crystallized allotrope of carbon. In another embodiment, porous ring 422 includes graphite. In another embodiment, porous ring 422 includes silicon carbide.

The horizontal cross-section of porous ring 422 may be defined by any symmetrical or asymmetrical shape used in the extrusion arts or the direct chill casting arts. For example, the horizontal cross-section of porous ring 422 may be defined by a circular shape, a square shape, a star shape, an oval shape, or a rectangular shape. Since the preferred shape of a billet is a that of a cylinder, in one embodiment, porous ring 422 is defined by a circular shape.

Mold tang 424 of FIG. 4 may server as the lower part of casing 426 and function to provide structural support to billet 132 in addition to drawing away some heat from sump 182 of molten material head 154.

The heat drawn from the molten material head within a sump by the porous ring principally forms a billet shell. After the billet shell is formed, molten material continues to harden near the porous ring and become part of the billet shell. On hardening, the material shrinks away from the porous ring. After shrinking away from the porous ring, the heat and the outward radial pressure from the molten material in the sump softens the billet shell and pushes the material towards the porous ring. As this soften material moves towards the porous ring, the material re-hardens. On re-hardening, the material shrinks away from the porous ring to experience the heat and the outward radial pressure from the molten material in the sump. This cycle repeats itself, the effect of which defines a subsurface liquation band adjacent to the Y-surface of the billet. The subsurface liquation band is characterized by an undesirable subsurface solidification segregation.

It is desirable to minimize the subsurface liquation band. The subsurface liquation band may be a function of at least one of the outward radial pressure from the molten material in the sump, the solidification temperature range of the material, the distance between the point of cooling media impingement and the point of first contact of the molten material meniscus on ring 422, the impingement velocity of the cooling media, the value by which the molten material temperature is higher than its normal melting point, and the rate at which the ram 150 is lowered. The outward radial pressure from the molten material in the sump may be a function of the depth of the sump. As the sump depth decreases, the outward radial pressure from the liquid molten material may decrease. A decrease in outward radial pressure from the molten material desirably may decrease the subsurface liquation band. Thus, it may be desirable to minimize the sump depth. In a practical environment of continuous casting, it may not be possible to change quickly the material feed level inside the feeder tube 114 and the material temperature since these variables may have high inertia, where the high inertia may be due in part to the variables being maintained by the continuous supply of molten material from a material melting furnace.

One technique to minimize the sump depth is to impinge the billet Y-surface with coolant as close as possible to the top, X-surface of the billet. In other words, the closer to the top X-surface of the billet that the coolant water impinges the billet Y-surface, the shallower the sump depth.

The X-surface of the billet where the coolant water impinges the billet Y-surface may be a function of at least the vertical span of a heat absorbing ring. The longer the vertical span of a heat absorbing ring, the further from the top X-surface of the billet that coolant water impinges the billet Y-surface. The shorter the vertical span of a heat absorbing ring, the closer to the top X-surface of the billet that coolant water impinges the billet Y-surface. However, the vertical span of a heat absorbing ring must be beyond a minimum length to prevent molten material from bleeding out the bottom of the heat absorbing ring.

Recall that mold tang 424 of FIG. 4 may server as the lower part of casing 426 and function to provide structural support billet 132 in addition to drawing away heat from molten material head 154. The longer the vertical span of a mold tang, the further from the top X-surface of the billet that coolant water impinges the billet Y-surface. Conventionally, industry standard for heat absorbing rings includes a one inch high graphite ring and a ⅝ inch high mold tang to present a 1-⅝ inches vertical span of an industry standard heat absorbing ring.

A surprising result of the coolant curtain of the invention is that the efficiency of this coolant curtain permits the vertical span of heat absorbing ring 420 to be as low as ⅞ inches. This reduction in the height of heat absorbing ring 420 may represent a 25% improvement over conventional industry standards. The low vertical span of heat absorbing ring 420 may significantly reduce the sump depth while at the same time may achieve an improvement in the metallurgical structure of the cast material.

Metallurgical structure may be viewed as a collective term that may describe the following attributes of the cast material. The metallurgical structure may be superior if the attributes include at least one of the following: (i)finer interdendritic spacing; (ii) minimum sub-surface liquation; (iii) minimum microsegregation within the grain; (iv) minimum macrosegregation from the surface to the axis of the billet; (v) finer grain size; (vi) absence of shrinkage porosity; and (vi) avoidance of undesirable precipitation of eutectic and peritectic primary phases. Moreover, by hitting metal much earlier with coolant, casting speed may be increased. Achieving higher casting speed may maximize productivity for each eight man-hour shift employing the embodiments of the invention.

In one embodiment, the vertical height of heat absorbing ring 420 is less than 1-⅝ inches. In one embodiment, the vertical height of heat absorbing ring 420 is in the range of ⅞ inches and 1-⅜ inches. In another embodiment, the vertical height of porous ring 422 is in the range of ⅜ inches to ⅞ inches and the vertical height of mold tang 424 is in the range of ⅜ inches to ⅝ inches. In another embodiment, the vertical height of porous ring 422 is one of ⅜ inches, ⅝ inches, and ⅝ inches and the vertical height of mold tang 424 is one of ⅜ inches, ⅜ inches, and ⅜ inches.

Coolant box 416 may include baffle ring 430 as a static device that regulates the flow of coolant. FIG. 5 illustrates an isometric view of baffle ring 430. As shown in FIG. 4, baffle ring 430 may be slip fit or compression fit within coolant box 416 and retained in the Y-direction by coolant ring 418 and mold casing 426. Since baffle ring 430 may be placed within coolant box 416 without the need to machine baffle ring retaining lips within the material of coolant box 416, the manufacturing costs of and waste material from this embodiment of the invention are dramatically reduced in comparison with conventional DC casting molds.

In addition to porous ring 422 and mold tang 424, mold body 410 may also include mold casing 426 and retaining ring 428. Within mold casing 426 of FIG. 4 installed into baffle ring 430 from the top, retaining ring 428 and gravity may be used to secure mold casing 426 to coolant box 416 as shown. Gaskets 432 may be used as indicated to prevent the escape of a fluid, such molten metal or coolant. Mold casing 426 may include direction surface 434 and threaded holes 436.

Also included with DC casting mold 400 may be mold starting head 412. Mold starting head 412 is similar to mold starting head 112 of FIG. 1. Mold starting head 412 may include a base and a threaded cavity into which a hydraulic ram may be secured. Moreover, mold starting head 412 may serve as an unattached bottom to heat absorbing ring 420.

Feeder tube 414 may include ceramic ring 438. Ceramic ring 438 may be installed into mold casing 426 from the top so that gravity aids in sealing ceramic ring 438 to mold casing 426.

A mold table may include two or more molds that are fed molten material from the same horizontal fluid flow channels. Where coolant box 416 is part of a mold table, it may be important to provide an intermediate connection between a horizontal fluid flow channel of the mold table and the inlet to mold body 410. Thus, feeder tube 414 may further include ceramic header 440. Ceramic header 440 may include header opening 442. FIG. 6 illustrates an isometric view of ceramic header 440.

To secure ceramic header 440 to ceramic ring 438 and secure ceramic ring 438 to mold casing 426, an embodiment of the invention may provide tubular supports 465 disposed about hold down bolts 441 and below header retaining ring 444. With header retaining ring 444 disposed on the top surface of ceramic header 440, hold down bolts 441 may be placed through openings in header retaining ring 444 and in tubular supports 465 and secured into threaded holes 436 of mold casing 426. Tubular supports 465 may work to prevent the use of excessive torque while assembling DC casting mold 400. In turn, this may work towards retaining a fragile integrity of ceramic ring 438 over a longer duration as may b measured in years.

Ceramic gasket paper 446 may be used as indicated to prevent leakage of molten material from feeder tube 414. Colloidal graphite filling, such as filling 447, may be used where needed to further act as a gasket and prevent leakage of molten material, to impart the surface lubricating property to otherwise rough surface of ceramic ring 438, and to fill in corners so that crevices do not exist in the travel path of molten material, such as molten material 152.

Another item that may be included as part of DC casting mold 400 may be coolant ring 418. Included with coolant ring 418 may be lip 450 and regulation surface 452. As best seen in FIG. 4, lip 450 may extend radially outward to provide a surface through which coolant ring 418 may be secured to coolant box 416. In one embodiment, coolant ring 418 is secured to coolant box 416 by a series of bolts from the bottom side of coolant box 416. In another embodiment, coolant ring 418 is secured to coolant box 416 by a series of latches, each of which may include a bar that fits over a hook and is secured by depressing on a lever coupled to the bar. In another embodiment, coolant ring 438 may be engaged by threads to the inside surface of baffle ring 430 and can be remotely made to move up or down with a gear mechanism.

With coolant ring 418 installed into coolant box 416, regulation surface 452 of coolant ring 418 may meet direction surface 424 of mold casing 426 at an angle to define an internal nozzle region and a nozzle opening. The angle, nozzle region, and nozzle opening may be similar to angle 168, internal nozzle region 166, and nozzle opening 170 of FIG. 2.

To regulate the fluid volume and force of the coolant curtain and direction of the coolant curtain, nozzle opening 170 of this embodiment may be modified by disposing or removing shims between lip 450 and coolant box 416. A shim may be viewed as a thin, often tapered piece of material used to adjust something to fit as desired. The shims may include aluminum foil, thin gage stainless steel sheet, or any gasket material.

An embodiment of the invention may include a set of shims, where the quantity of the set may range from one to one-hundred. An embodiment of the invention may include a set of ten shims as part of a tooling package that includes a DC casting mold of the invention. Each shim in the set of ten shims may be defined by a thickness within the range of 0.001 to 0.01 inches, where the thickness of each shim is unique within the set of ten shims. An alternate set of ten shims may be defined by a thickness of 0.01 inches, where each shim is 0.01 thick.

Different alloys have different heat transfer characteristics. For example, there are about sixty aluminum alloys, each having a different heat transfer characteristic. Conventional practice requires employing a different tooling package for each alloy to be cast or employing a uniquely researched and exhaustive combination of ram speed, coolant volume & pressure, material temperature, casting start-up sequence, etc. for each alloy. However, each shim of the invention may provide the ability to change the heat transfer characteristics of the mold such that different alloys may be cast with the same tooling package using the pre-set casting practice steps. The ability to cast different alloys with the same tooling package of the invention and with the identical casting practice is in stark contrast to the conventional practice of employing either a different tooling package or a new set of practice steps for each alloy to be cast.

FIG. 7 illustrates DC casting mold system 700 of the invention. Included within DC casting mold system 700 may be mold table 702 having DC casting molds 400. DC casting molds 400 may also be DC casting molds included with mold system 102. Also included with DC casting mold system 700 may be various control systems and auxiliary systems as noted above.

FIG. 8 is an isometric top view of mold table 702 of FIG. 7. As seen, supply channel 704 of mold table 702 provide a path for molten material to reach each header opening 442.

Since a billet may be formed by passing through heat absorbing ring 420 of FIG. 4, a friction reducing element may be included between the billet surface and heat absorbing ring 420 to aid in this passage. In one embodiment of the invention, lubricant is introduced to the outer diameter side of porous ring 422 through lubricant supply channel 454. Lubricant supply channel 454 may be flexible and may be coupled to mold casing 426 through coolant ring 418 such that lubricant supply channel 454 does not interfere with the coolant curtain. This may be achieved by routing lubricant supply channel 454 from the bottom of coolant box 416, between the interior of coolant ring 418 and the exterior of the coolant curtain, and securing lubricant supply channel 454 to mold casing 426. A shaft end of lubricant supply channel 454 may be secured to mold casing 426 by thread engagement or a ball and detent engagement.

In conventional DC casting molds, where the mold is fitted from the top of the mold table, the lubricant supply channel is routed from the top of the mold table as well. Routing lubricant supply channel 454 from the bottom of coolant box 416 between the interior of coolant ring 418 and the exterior of the coolant curtain allows more DC casting molds per unit mold table area and eliminates the need for seals between the baffle ring and the lubricant supply channel. Eliminating the need for seals between the baffle ring and the lubricant supply channel works towards minimizing the chances of lubricant mixing with coolant water.

FIG. 9 is an isometric bottom view of mold table 702 of FIG. 7. Coolant ring 418 and lubricant supply channel 454 of FIG. 4 may be seen in this view. FIG. 10 illustrates billets 1000 produced by the invention. Billets 1000 may be narrow or may have a large diameter. For example, billets may twenty feet long and have a diameter of twenty six inches. Standard six foot man 1002 provides a reference as to the large scale of billets 1000 shown at twenty feet long and have a diameter of four inches.

EXAMPLES

Although heat transfer from hot materials to flowing cooling media has been researched for over a century and heat transfer in direct chill casting for over half a century, no researcher has put together a dynamic model of heat transfer in direct chill casting without making certain assumptions and accepting many approximations. A holistic approach has been lacking. Partly, this has been due to the fact that the rate of heat transfer abruptly jumps by one to two magnitudes of change in the nucleate boiling zone.

When ordinary water is used as coolant, the temperature range in which nucleate boiling takes place is 330° F. to 390° F. Particularly, in the case of direct chill casting of aluminum alloy as practiced with recycled water as cooling media, the initial surface temperature of the aluminum presented to the stream of water may be in the range of 1100° F. to 1200° F. As water at room temperature (or within +/−50° F. from room temperature) encounters a 1200° F. surface, a variety of reactions take place at the interface. Essentially, these reactions are both physical and chemical in natural.

Using the laws of thermodynamics and the simultaneous conduction and convection heat-mass transfer equations, researchers have formulated various heat transfer models in general. However, these models are not sufficient for predicting the casting behavior and the metallurgical structure of the cast material. One reason for this may be that the temperature distribution is constantly changing on the cast material surface and the true "steady state" temperature distribution is a pattern of changing conditions oscillating within a certain interval. These changing conditions may be dictated by (a) casting variables such as speed, water volume, mold geometry, metal temperature, and alloy specific physics, and (b) extraneous factors such as start up conditions, mold fill rate, rate of change of feed material temperature, heat transfer through ceramic feeder tube, oxidation of molten material and several other parameters such as atmospheric temperature, and humidity, each of which lie outside the scope of the equations used to build the model. Accordingly, experimentation is a chief way to develop and test direct chill casting mold systems. Below are experiments that accompany the invention.

Example 1

Set Up: Tooling for a billet mold system was manufactured per the above embodiments to cast aluminum alloy billets using city water as cooling media. The tooling was built to cast (i) 6 inch (")diameter billets in a mold table having a thirty mold capacity, (ii) 7" diameter billet in a mold table having a twenty four mold capacity, (iii) and 8" diameter billet in a mold table having an eighteen mold capacity. In each of the above three situations, the mold body that provided a directing surface was fitted from the top side of the coolant box. Moreover, a water ring (coolant ring) having a regulation surface was attached from the underside of the coolant box. A lubrication shaft was run through the coolant ring and the coolant box. The set up did not include a provision of steam exhaust duct in the DC casting pit. The total manufacturing cost of the tooling as described above ranged around U.S.$180,000+/−U.S.$30,000. This cost included the cost of the mold table of which the coolant box is an integral part.

In operation, the height of the porous lubrication ring was held constant at 0.81 inches and height of the mold tang was held constant at 0.66 inches thus the total height of the heat-absorbing ring was kept at 0.147". The angle of the direction surface with respect to the horizontal plane was kept fixed at 62.5 degrees. The total supply volume of the coolant was kept constant at 720 gallons per minute at the supply pressure of nine pounds per square inch down stream of the in-line coolant filter. The coolant temperature on the supply side was maintained in the range of 75 degrees +/−five degrees F. The molten metal temperature was maintained in the wider range of 1250 to 1350 degrees F. Addition of 0.003% Titanium (in line) was made to molten metal for grain refinement. Peanut oil was used as lubricating medium and its supply was regulated at 0.005 cubic inches per mold at an interval of every 20 seconds. In the first set of trials, the nozzle opening was kept constant at 0.93 inches and nozzle height of zero inches.

In production, more than a dozen castings were carried out in each billet size in alloy AA 6063 (Aluminum Association (AA) Specification). Billet lengths ranged from 225 to 240 inches and the total average weight of each cast was about 21,000 pounds.

Example 1 Observations

In observation, the castings could be conducted without encountering any problem related to dimensional stability of the mold system. The mold system remained rigid and showed excellent resistance to thermal fatigue resulting from start and completion of the casting cycle. No leakage was observed in the molten metal, coolant media or lubrication line flow paths over repeated uses of the mold package. No steam was observed in the immediate vicinity of water impingement location on the billet and downstream of that point under the mold table or above the mold table. The surface of the billet was smooth and qualifying for the required industry standard set for direct extrusion application. The metallurgical structure of the billet exhibited 75 microns as grain size and around 42 microns as cell size (interdendritic spacing) at the center of the billet. The sub-surface liquation band varied in depth ranging from 0.015 to 0.060 inches with average close to 0.030 inches. The casting speeds that could be attained without inducing cracking, tearing or bleed out were 4.5"/minute (min) for 8"dia, 5"/min for 7"dia and 5.5"/min for 6"dia.

Example 2

Set Up: Conditions mentioned in example 1 were maintained except recycled water was used as cooling media. The recycled water typically had the following chemistry:

Total dissolved solids of 1,200 milligrams per liter (as compound to 250 milligrams for city water);

Total suspended solids which generated about two pounds per square inch (psi) pressure difference across the in-line filter during the course of the casting (mesh opening 0.064 inches); and Total oil and grease content of 60 milligrams per liter.

Example 2 Observations

In observation, as a result of using recycled water, no deleterious effect was observed on the functioning of the mold system. No change was required in the casting practice of the billets, the same thresholds of casting speeds could be maintained with recycled water as with direct city water. The metallurgical structure of the billet did not indicate any difference from that observed in example 1.

Example 3

Set Up: From example 2, the nozzle opening was narrowed to 0.79 inches and nozzle height was changed from zero to 0.01 inches. All other parameters remained the same as set out in example 2. Twenty one castings were made in billet size of 8" diameter. The lengths of the billets varied from 120 inches to 236 inches.

Example 3 Observations

In observation, the overall functioning of the mold system improved. This was evidenced by the ability to cast the metal at higher casting speeds without affecting the metallurgical structure, the surface of the cast product or the overall castability of the alloy. The casting speeds in excess of 5.25 inches per minute were registered for 8" diameter billet. This represents an improvement in the overall productivity in excess of 16%. This significant increase in the casting speed is attributed to having achieved a superior surface heat transfer coefficient resulting from changing nozzle opening and nozzle height. Which in turn changed the area of nucleant boiling region, provided higher impingement velocity and simultaneously maintained shearing currents within the coolant curtain which assisted in faster removal of the steam bubbles from the surface of the billet.

Example 4

Set Up: Identical conditions were maintained as given in example 3 except the material chemistry was changed to alloy AA 2024 (Aluminum Association (AA) Specification). Alloy AA 2024 material, containing copper and magnesium, has higher susceptibility for cracking due to its larger solidification temperature range and due to the fact that it undergoes higher solidification shrinkage than alloy AA 6063.

Example 4 Observation

In observation, based on the sump data and heat transfer curves, the practice could be easily developed for casting this material with the aforementioned embodiments of the present invention. The metallurgical structure of the cast alloy AA 2024 qualified all requirements pertaining to the specifications to manufacture extrusions and forgings for a wide range of end use applications.

Example 5

Set Up: All the conditions were maintained same as in example 3 except the angle of the direction surface of the impinging coolant with respect to the horizontal plane was changed from 62.5 degrees to 72 degrees.

Example 5 Observation in observation, the casting speed of 5.64 inches per minute was repeatedly achieved for casting of 8" diameter AA 6063 alloy billet. These casting speeds are well beyond the conventional Direct Chill casting industry standards and provide significant bottom line advantages to the billet manufacturer.

Advantages

The DC casting mold and mold system embodiments of the invention provide an enormous advantage in that they produce a superior metallurgical structure, are easily assembled, easy to repair/maintain, increase casting productivity and most importantly permit immediate in-situ adjustments to effectively control heat transfer. This also helps to reduce research time and expense associated in making newer alloys. The highly simplified tooling of the embodiments may be assembled from the top of the mold table so as to take advantage of gravity in sealing the mold from coolant water leakage. Moreover, the lubricant supply channel may be routed from the bottom of the mold table and through the coolant ring.

The dynamically adjustable cooling capability of a DC casting mold of the aforementioned embodiments provides the ability to effectively manage the castability of the material until the steady-state casting conditions are attained. This ability is critically required in the continuous and semi-continuous casting of those materials that show susceptibility to hot-cracking, cold-cracking, surface tearing, and bleeding. Typically these materials exhibit following properties: (i) high solidification shrinkage (i.e. the shrinkage which the material undergoes as its state changes from that of liquid to solid), (ii) larger solidification temperature range (i.e. the temperature range from the emergence of the first particle of solid to the disappearance of the last droplet of the liquid from the sump), and (iii)lower internal heat conductivity than external (i.e. at surface) heat transfer coefficient.

Due to the reduction of the number of parts in the embodiments, the cost per unit is dramatically lower than conventional DC casting mold and mold system. For example, a conventional thirty strand DC casting mold for seven inch diameter billets may cost U.S.$300,000. A DC casting mold for seven inch diameter billets employing the invention may cost U.S.$210,000, a savings of U.S.$90,000. The reduction in the number of parts in the embodiments corresponds to less parts that wear and need to be replaced. This may work towards reducing the cost of the spare parts and those parts that may be consumed in use (for example, the consumables). Additionally, with lesser parts there is a lesser chance of molten metal or coolant leakage due to the reduced number and surface area of mating surfaces. This results in a much lower probability of uncontrolled metal to coolant reactions, some of which are known to turn explosive in nature.

The DC casting mold and mold system embodiments of the invention provide additional advantages. Conventionally, interrupted flows of coolant and turbulent flows of coolant promote free rising steam generation by failing to shear minute steam bubbles from the surface of the billet. However, the mold water ring geometry embodiments may control the generation of steam in a casting station through nozzle opening 170 of FIG. 2, angle 134, and nozzle height 172, particularly where nozzle height 172 is zero inches. Since coolant curtain 130 may be an uninterrupted, laminar flow of coolant disposed about billet surface 133, free rising steam generation further is minimized by the invention. Controlling the generation of steam maximizes the visibility of the product being manufactured and thus increases operator and equipment safety. Further, controlling the generation of free rising steam may eliminate the need to employ an expensive steam suction blower system.

When coolant in a DC casting operations is recycled as is the typical practice, the recycled coolant builds up a great amount of foreign particles. These foreign particles tend to choke the cooling passages. Moreover, if the quality of the cooling media is not good then deposits or sediments can crystallize on the back side of the mold (for example, on direction surface 434 in FIG. 4). If these deposits are not removed periodically, the deposits will reduce the heat conductivity of the mold. An example is, if recycled water having a high water hardness is used as a cooling media, then Calcium and Magnesium deposits very commonly form on the back side of the mold.

Conventionally, maintenance such as inspection and cleaning of the cooling passages of a DC casting mold is a routine chore that is done after the completion of each casting. Besides cleaning a mold, the mere inspection of the cooling passages of a conventional mold is in itself a cumbersome and lengthy task. The entire mold with all of its seals has to be taken apart. This takes significant time away from the time that may be used for billet production.

In comparison to conventional DC casting molds and mold systems, the maintenance access to the coolant channels of the invention is very accessible in that, on removing a coolant ring located underneath a mold of the invention, a worker may easily clean out the passages in the coolant channels. Experiments have shown that one DC casting mold of the invention may be cleaned and placed back in service within three minutes. This maintenance time of the invention is in stark contrast with the twenty minute maintenance time of one conventional DC casting mold. Thus, the exceptional maintenance aspects of the invention reduce the total casting turn-around time, thereby further adding to the productivity.

The heat transfer surfaces of the heat absorbing ring of conventional DC casting mold systems are so inaccessible that maintenance workers often over look clearing off calcium buildup on the heat transfer surfaces. However, a maintenance worker located underneath mold table 702 as seen in FIG. 9 may clear off calcium buildup on the heat transfer surfaces of the heat absorbing ring of the invention without removing any components of the invention. The ease with which the coolant channels of the invention may be maintained relaxes the stringent filtration requirements for the coolant employed in conventional DC casting mold systems.

The user friendly, cheaper, and simple embodiments of the invention translate into a longer life DC casting mold. Since different alloys may be cast with the same tooling package of the invention, the invention has a broader application in the billet production industry than conventional DC casting molds. Moreover, the refined embodiments permit more DC casting molds per unit area in mold table 702 than conventional DC casting mold designs. This may provide a more aggressive management control over billet production.

The environmentally friendly, DC casting mold and mold system embodiments of the invention provide advantages in casting speed leading to productivity improvement, subsurface liquation band minimization leading to metallurgical improvement, fabrication ease, assembly ease, and alloy versatility leading to quality and productivity improvement, fewer number of parts leading to economical value, cleanability leading to maintenance improvement, and safety improvement. Thus, the embodiments of the invention renders a DC casting mold package having a great number of improvements for the operator to use from which the billet production plant may benefit.

The exemplary embodiments described herein are provided merely to illustrate the principles of the invention and should not be construed as limiting the scope of the subject matter of the terms of the claimed invention. The principles of the invention may be applied toward a wide range of systems to achieve the advantages described herein and to achieve other advantages or to satisfy other objectives, as well.

What is claimed is:

1. A method for direct chill casting, comprising:

passing coolant through a nozzle of a direct chill casting apparatus, wherein the direct chill casting apparatus comprises a means for holding coolant coupled to an underside of a mold body, and a coolant ring coupled to an underside of the means for holding coolant, wherein the nozzle is formed by a first surface and a second surface, wherein the first surface is a direction surface and the second surface is a regulation surface, wherein the first surface is part of a first direct chill casting mold component and the second surface is part of a second direct chill casting mold component, the second direct chill casting mold component different from the first direct chill casting mold component, the first direct chill casting mold component and the second direct chill casting mold component constituting a first component/second component pair, the first component/second component pair selected from the group consisting of the mold body/the coolant ring, the means for holding coolant/the coolant ring and the mold body/the means for holding coolant, wherein said mold body further comprise a heat absorbing ring, wherein said absorbing ring comprise a porous ring having a height, wherein the height of said porous ring is in the range of ⅜ inches to ⅞ inches;

hardening molten material by passing the molten material through the mold body and the coolant ring and contacting the molten material with a mold starting head; and passing the hardened material through the coolant curtain by lowering the mold starting head.

2. The direct chill casting method of claim 1, further comprising:

adjusting the nozzle.

3. The direct chill casting method of claim 2, further comprising:

readjusting the nozzle as the hardened material passes through the coolant curtain.

4. The direct chill casting method of claim 2, wherein adjusting the nozzle includes at least one of rotating a gear and adding a shim, wherein the gear is in rotational contact with at least one of the coolant ring and the mold body, and wherein the shim is disposed between at least one of the means for holding coolant and the mold body and the coolant ring and the means for holding coolant.

5. The direct chill casting method of claim 1, wherein the heat absorbing ring is defined by a span that is less than 1-⅝ inches.

6. The direct chill cast method of claim 5, wherein the span is in the range of ⅞ inches and 1-⅜ inches.

7. The direct chill casting method of claim 6, the heat absorbing ring further comprising a mold tang having a height, wherein the height of said mold tang is in the range of ⅔ inch to ⅝ inch.

8. The direct chill casting method of claim 1, wherein the mold body further comprises a mold casing, the mold casing comprising a mold tang, a retaining ring, and a porous ring coupled to the mold casing at a location that is adjacent to the mold tang, wherein the retaining ring couples the mold casing to the means for holding coolant.

9. The direct chill casting method of claim 1, wherein the means for holding coolant is a coolant box.

* * * * *

UNITED STATES PATENT AND TRADEMARK OFFICE

CERTIFICATE OF CORRECTION

PATENT NO. : 6,675,870 B2
DATED : January 13, 2004
INVENTOR(S) : Tilak

It is certified that error appears in the above-identified patent and that said Letters Patent is hereby corrected as shown below:

Column 2,
Line 14, please delete “Thee” and insert -- The --.

Signed and Sealed this

Second Day of November, 2004

JON W. DUDAS
*Director of the United States Patent and Trademark Office*